United States Patent [19]

Cingle, III

[11] Patent Number: 4,938,459

[45] Date of Patent: Jul. 3, 1990

[54] MECHANICALLY SEALED TUYERE BLOCK

[75] Inventor: George Cingle, III, Gibsonia, Pa.

[73] Assignee: Allegheny Ludlum Corporation, Pittsburgh, Pa.

[21] Appl. No.: 363,644

[22] Filed: Jun. 8, 1989

[51] Int. Cl.[5] ..... C21B 7/072

[52] U.S. Cl. ..... 266/224; 266/218

[58] Field of Search ..... 266/218, 224, 265, 266, 266/270

[56] References Cited

U.S. PATENT DOCUMENTS 4,470,582 9/1984 Shaw et al. ..... 266/266

4,687,184 8/1987 LaBate et al. ..... 266/270

*Primary Examiner*—S. Kastler

*Attorney, Agent, or Firm*—Patrick J. Viccaro

[57] ABSTRACT

A tuyere block assembly design permitting intermittent flow of gas into the bottom of a metallurgical vessel is provided having the tuyere block assembly open to permit flow of gas into the vessel and closes when the flow of gas into the furnace is not desired without the requirement that gas be continuously injected through the tuyere block in order to keep the block open and operational.

16 Claims, 1 Drawing Sheet

MECHANICALLY SEALED TUYERE BLOCK

BACKGROUND OF THE INVENTION

1. Field of the Invention:

The present invention relates to metallurgical process vessels, in general, and to tuyeres for bottom blown furnaces, basic oxygen furnaces (BOF's), in particular.

2. Description of the Prior Art:

Several types of devices are known for introducing gases into the inner volume of metallurgical process vessels. The most common ones of these devices include: (a) tuyeres--either single annulus, annulus-tube (AOD), or single tube, (b) porous plugs, and (c) solid refractory blocks which are either machine bored or etched. A problem with existing tuyeres, porous plugs, etc. which are installed in the bottom of metallurgical process vessels is that they have no positive way of opening and closing on demand. Gas must continuously flow through these devices to keep them open and operational. An advantage exists, therefore, for devices that can be opened or closed to allow the flow of gas as it is required, without detrimental plugging or fouling occurring in the devices. By providing the flow of gas only as required, such devices will make the most economical and efficient use of the gas.

It is therefore an object of the present invention to provide a new type of device which will permit or stop the flow of gass to the bottom of metallurgical vessels, such as BOF's on demand.

It is a further object of the present invention to provide a device of such rugged contruction having a service life comparable to existing tuyeres, porous plugs, etc.

Still other objects and advantages will become apparent from the attached drawings and description of the invention presented hereinbelow.

SUMMARY OF THE INVENTION

In accordance with the present invention, there is disclosed a tuyere block design which permits intermittent gas flow therethrough into the bottom region of a metallurgical vessel. The tuyere block operates to open and close repetitively and on demand to permit or stop flow of the gas to the vessal. The tuyere block is a solid refractory block containing therewithin a movable refractory plug. The outer surface of the movable plug and the inner surface of the block are provided with mating annular seals. When seated against the block the plug prevents egress of the liquid metal from the vessel which could clog and/or foul the tuyere block. The plug is seated against the block by virtue of the ferrostatic head of the molten metal bath within the vessel. Preferably an urging force, such as a spring force is exerted on the plug by an internal spring assembly mounted within the plug. To unseat the plug from the block in order to inject gas into the vessel, the gas is first introduced via a gas supply pipe into a plenum chamber formed between the plug and block. When the pressure of the gas is sufficient to overcome the ferrostatic head of the molten bath within the vessel as well as the spring force, the plug becomes unseated from the block and gas is injected into the vessel through an annular space formed between the plug and the block. When the gas pressure is sufficiently reduced, the plug then reseats against the block preventing further ingress of gas into the vessel as well as egress of the molten metal bath from the vessel and into the gas supply pipe.

DESCRIPTION OF THE PREFERRED EMBODIMENTS

Figure 1:
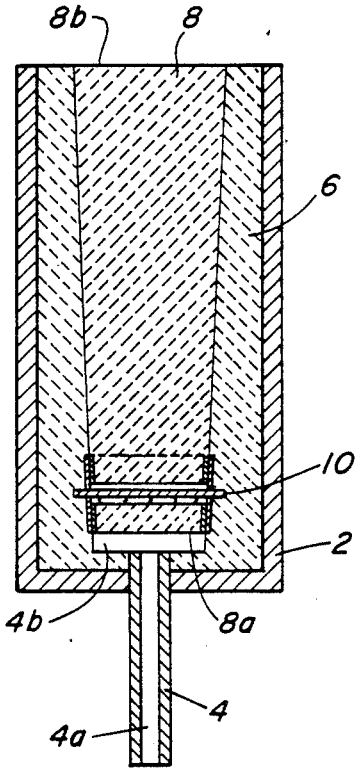
FIG. 1 is a vertical cross-section of the tuyere block of the present invention.

In FIG. 1 there is depicted a tuyere block assembly constructed in accordance with the present invention. Tuyere block assembly 1 is provided with an outer steel casing or housing 2. Housing 2 provides a gas tight seal for the block assembly when the assembly is positioned in the bottom of a metallurgical vessel, e.g. BOF (not shown).

A gas supply pipe 4 introduces gas into the block assembly 1. Typically, in a BOF, the gas is an inert gas, but any gas could be used for different metallurgical purposes. The gas supply pipe 4 is welded to the outer steel casing 2 and provides a passageway **4*a* for introducing gas into a plenum 4*b* of the tuyere block assembly 1. From the plenum 4*b*** the gas is then injected under pressure into the BOF to mix the molten metalcontents thereof as will be described hereinbelow.

Block assembly 1 includes a solid refractory block 6 having a passage means therein. Particularly, a frustum shaped passage may be used, such as a frustoconical passage formed therein for receiving a mating, frustoconical, solid refractory central plug means 8. The smaller diameter end of the frustoconical shape is adjacent the plenum **4*b*. A retaining means may include holding pin 10 which passes through a bore 12 drilled diametrically through the plug 8 near the smaller diameter end thereof. Opposite end portions of the pin 10 are anchored in the refractory material forming the block 6 and the bore 12 is sufficiently larger than pin 10 to permit retention of plug 8 in block 6 and reciprocation of the plug 8 relative to the block 6 such that the plug 8 may become seated in and/or unseated from the block 6. The purpose of the retaining means is to permit relative reciprocal movement between the plug means 8 and block 6. Holding pin 10** should be made of a rigid material such as a steel alloy.

In the most preferred embodiment, the bore 12 is significantly larger than the pin 10 so that it can accommodate not only pin 10 but also a plurality of urging means, such as springs 14 which are secured at first ends thereof to the pin 10 and which compressively abut at second ends thereof a bottom portion of the wall of bore 12. The purpose of springs 14 is described in more detail hereinbelow.

Figure 2:
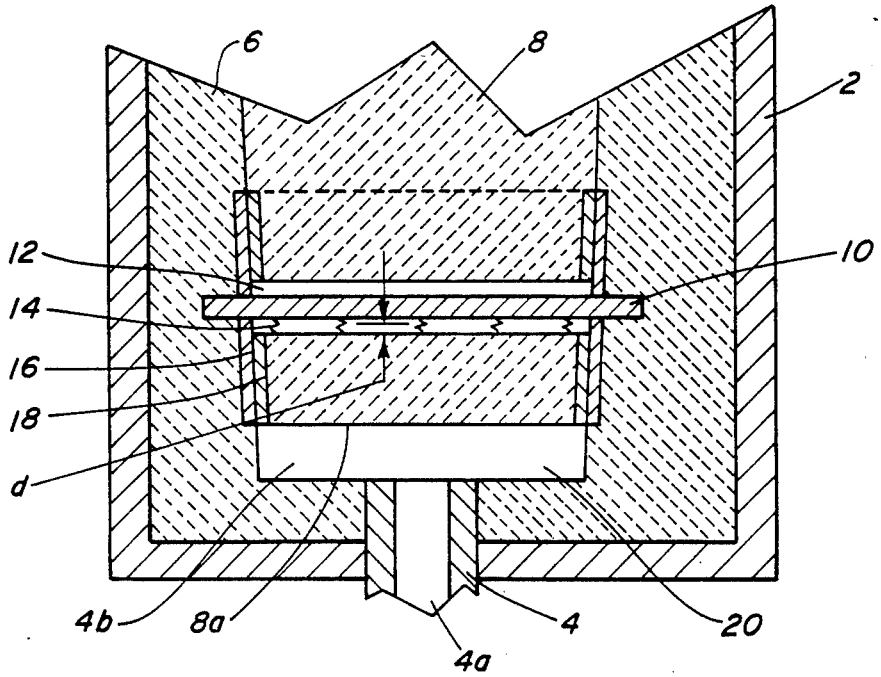
FIG. 2 is an enlarged view of a portion of FIG. 1.

The block 6 is provided near the small diameter end or bottom of its frustoconical passage with an annular, downwardly and radially inwardly tapering, steel seat member 16. As best shown in FIG. 2, the radially innermost surface of seat member 16 is flush with the surface of the frustoconical passage formed in the block 6 so that a smooth and continuous frustoconical surface is formed in the block 6 for receiving the mating frustoconical plug means 8. Similarly, the plug 8 is provided near the smallest diameter end thereof with a mating, annular, downwardly and inwardly tapering, sleeve member 18. The radially outermost surface of sleeve member 18 is flush with the outer surface of the plug 8 so that a smooth and continuous frustoconical surface is formed on the plug for mating with the smooth and continuous frustoconical surface formed in the frustoconical passage of the block. As is shown in the drawings, when the plug 8 is fully seated within the block 6, sleeve member 16 seats in sealing engagement with seat member 18.

The seat member 16 and sleeve member 18 further serve to absorb the majority of the impact force occurring between the block 6 and plug 8 upon closing of the tuyere block assembly 1 thus preventing chipping or other damage which might occur to the refractory material of the block and/or plug upon repeated impacts therebetween. Seat member 16 and sleeve member 18 therefore serve to extend the life of the tuyere block assembly 1. For that reason seat member 16 and sleeve member 18 are made of impact resistant material, such as steel alloys.

A general description of the various elements and the operation of the tuyere block assembly 1 as a unit are as follows. Although the tuyere block assembly is shown vertically, reference to terms "top" and "bottom" are only relative to installation in the bottom of a metallurgical vessel. The tuyere assembly may be used in other orientations, such as in the sidewall of the vessel.

The solid refractory block 6 serves three purposes: (1) it holds the entire tuyere block assembly together, (2) it retains the seat member 16 so that the sleeve member 18 of central solid refractory plug 8 can seat against it for providing gas-tight shutoff of the assembly, and (3) it anchors the holding pin 10 passing through bore 12 in plug 8 thus preventing the plug from floating out of the block and into the steel bath in the furnace. As shown in FIG. 2, bore 12 extends through sleeve member 18 that holding pin 10 is closely received in seat member 16 of block 6 and extends therethrough for anchorage into block 6.

The refractory central cone or plug 8 can be compared to the "ball" in a check valve. Like the block 6, plug 8 is to be made of refractory material to withstand the molten steel bath within the metallurgical vessel.

As noted above, the holding pin 10 maybe a steel pin which is held in place by the solid refractory block 6. And, as previously mentioned, there are a plurality of springs 14 secured to the pin which depend therefrom and which are in compressive engagement with the adjacent portion of the wall of bore 12 in plug 8. Preferably, the spring means would be interposed between the pin 10 and wall of bore 12 which is closest to the plenum 4*b*. The springs 14 resist upward movement of the plug 8. In the tuyere block "normally closed" position with no gas flowing through the tuyere block assembly 1, the springs 14 are somewhat compressed and exert a downwardly directed force on the plug 8 to urge the plug into the down or "shut" position.

In order for gas flow to be achieved through the assembly 1, the pressure of the gas in plenum 4*b* which would be acting against the bottom surface 8*a* of plug 8 must be sufficient to overcome the ferrostatic pressure head of the molten steel bath against the top surface 8*b* of plug 8 and the resistance of springs 14 within bore 12. Maximum gas flow would occur when the maximum compression distance "d" of the springs is reached. The maximum spring compression distance "d" is seen in FIG. 2 and is equal to the maximum uplift distance of the center plug 8 relative to block 6, which would result in a corresponding maximum annular gap through which gas may flow when the tuyere block assembly 1 is in an "open" position.

The operation of the tuyere block assembly 1 of the present invention would be similar to that of a check valve. When no gas is flowing through gas supply pipe 4, the ferrostatic pressure of the molten steel bath in the BOF vessel and the compressive force of springs 14 exert downward force on the plug 8 causing the plug to sealingly seat on block 6 through the action of sleeve member 18 and seat member 16. Penetration of molten steel from the liquid steel bath through the tuyere block assembly 1 is kept to a minimum because the annular gap between the plug 8 and block 6 is closed to a small tolerance when the tuyere block is in the "normally closed" position.

When gas flow through the assembly is demanded, the pressure of the gas in plenum 4*b* would be raised by supplying additional gas to the plenum through gas supply pipe 4. The increased gas pressure in plenum 4*b* acting against the bottom surface of the plug 8 would overcome the ferrostatic head and the spring force, and the plug would be raised. The plug 8 rises until the springs 14 located between the pin and the bottom of bore 12 reach maximum compression. The annulus produced by the plug 8 moving up and out of contact from block 6 provides the path for the gas to reach the steel bath. The maximum and minimum diameters of the center cone or plug 8 would be so designed that large gas flow rates could be achieved through the tuyere block assembly 1 using a minimum of "overcoming" gas pressure through gas supply pipe 4. When the gas flow is shut off, the steel bath ferrostatic pressure on top of the plug 8 and the expansive force of springs 14 would move the plug 8 downwardly and cause it to seat and seal on the block 6 through contact between members 16 and 18.

While it is preferable to include springs 14 which are mounted to the holding pin 10 and compressively engaged with the wall of bore 12, it is also contemplated that the springs may be omitted so that only the ferrostatic head of the steel bath must be overcome in order to "open" the tuyere block assembly 1. However, it is preferable that the springs 14 be provided since they would exert a positive return force on the plug even in the event that the ferrostatic force exerted on the plug 8 by the liquid steel bath within the furnace might not be enough to positively seat the plug 6 in block 8. The new tuyere block assembly 1 would have many uses with blowing processes which inject gas through tuyeres into a metallurgical vessel. The new tuyere is especially attractive to melt shops which have a mixed product production schedule, with some grades processed with gas blown through bottom tuyeres, while other grades do not require it.

By its unique construction, the tuyere block assembly of the present invention would be virtually and totally resistant to clogging or fouling. By not being open at all times, it is not subject to continuous extreme heat conditions. Therefore, the improved tuyere block should have a service life which is comparable to, if not greater than, the service life of existing tuyeres, porous plugs, etc. since it is not susceptible to the constant extreme heat and/or potential fouling problems of related prior art structures.

While the present invention has been described in accordance with the preferred embodiments of the various figures, it is to be understood that other similar embodiment may be used or modifications and additions may be made to the described embodiments for performing the same functions of the present invention without deviating therefrom. Therefore, the present invention should not be limited to any single embodiment but rather construed in breadth and scope in accordance with the recitation of the appended claims.

I claim:

1. Tuyere block assembly for a metallurgical vessel, said assembly comprising:

means for supplying gas to the molten metal contents of said vessel;

block means having passage means therein for communicating with said gas supply means and with an interior volume of said vessel;

movable plug means received in said passage means for opening and closing said passage means; and pin means passing through said plug means and anchored in said block means for retaining said plug means in said block means.

2. The assembly of claim 1 wherein said retaining means further comprise said plug means having a bore therein for receiving said pin means therethrough, said bore means being greater in cross section then said pin means for loosely receiving said pin means therein and for permitting limited reciprocation of said plug means within said block means.

3. The assembly of claim 2 wherein said pin means has attached thereto at least one means for urging said plug means to close said passage means.

4. The assembly of claim 3 wherein said pin means and said urging means attached thereto are positioned within the bore means in the plug means.

5. The assembly of claim 4 wherein said urging means comprise spring means.

6. The assembly of claim 3 wherein said passage means is of a frustum shape with a narrower end of said frustum shape being located proximate said gas supply means and a wider end of said frustum shape being located proximate said interior volume of said metallurgical vessel.

7. The assembly of claim 6 wherein said plug means is of a mating size and frustum shape to cooperate with said frustum shape of said passage means.

8. The assembly of claim 7 wherein said narrower end of said passage means has seat means retained therein.

9. The assembly of claim 8 wherein said narrower end of said plug means has outer sleeve means retained thereon.

10. The assembly of claim 9 wherein seat means and said outer sleeve means extend flush with mating surfaces of said passage means and said plug means, respectively, and seating of said sleeve means against said seat means sealingly closes said passage means.

11. The assembly of claim 10 wherein said frustum shape of said plug means and said passage means is a frustoconical shape.

12. The assembly of claim 1 wherein said passage means further comprises a plenum, said gas supply means being operable to supply gas under pressure into said plenum, said pressurized gas acting on a first surface of said plug means to move said plug means away from a seating surface of said block means in order to open said passage means and to produce an annular space between said plug means and said block means through which said gas may travel from said gas supply means to said interior volume of said vessel.

13. The assembly of claim 12 wherein said plug means includes sleeve means and said seating surface of said block means is provided on a seat means retained in said block means; an outer surface of said sleeve means being flush with an outer surface of said plug means and said seating surface being flush with the surface of said passage means, whereby a seal is created between said outer surface of said sleeve means and said seating surface of said block means when said plug means closes said passage means.

14. The assembly of claim 13 wherein said plug means further includes a second surface opposite to said first surface upon which said molten metal contents in said interior volume of said vessel exert force in order to bias said plug means into a position to close said passage means.

15. The assembly of claim 14 wherein said block means and said plug means are formed of solid refractory material.

16. Tuyere block assembly for a metallurgical vessel, said assembly comprising:

means for supplying gas to the molten metal contents of the vessel;

solid, refractory, block means having a frustoconical passage means formed therein, said passage means communicating with said gas supply means and with an interior volume of said vessel;

solid, refractory, movable plug means of a frustoconical size and shape for mating with said frustoconical passage means, said plug means being movable for opening and closing said passage means;

said plug means including a bore diametrically through said plug means near a smaller diameter end thereof;

retaining pin means of a smaller cross sectional area than said bore, said retaining pin means being of a length which is greater than the length of said bore, said retaining pin means extending entirely through said bore and having end portions which project from opposite means of said bore and are anchored in said block means;

spring means attached to said retaining pin means and engaging the inner wall of said bore, and whereby the cross sectional area of said bore is sufficiently greater than the cross sectional area of said retaining pin means so as to permit movement of said plug means from a position contacting said block means for closing said passage means to a position separated from said block means for opening said passage means, said spring means urging said plug means to close said passage means.

* * * * *